US011214754B2

(12) United States Patent
Onouchi et al.

(10) Patent No.: US 11,214,754 B2
(45) Date of Patent: Jan. 4, 2022

(54) LOW VISCOSITY LUBRICATING OIL COMPOSITION

(71) Applicant: Chevron Japan Ltd., San Ramon, CA (US)

(72) Inventors: Hisanari Onouchi, Osaka (JP); Koichi Kubo, Kanagawa (JP); Isao Tanaka, Shizuoka (JP)

(73) Assignee: CHEVRON JAPAN LTD., Tokyo (JP)

( * ) Notice: Subject to any disclaimer, the term of this patent is extended or adjusted under 35 U.S.C. 154(b) by 0 days.

(21) Appl. No.: 16/159,777

(22) Filed: Oct. 15, 2018

(65) Prior Publication Data

US 2019/0119601 A1 Apr. 25, 2019

Related U.S. Application Data

(60) Provisional application No. 62/574,955, filed on Oct. 20, 2017.

(51) Int. Cl.

| | |
|---|---|
| ***C10M 169/04*** | (2006.01) |
| ***C10M 129/54*** | (2006.01) |
| ***C10M 139/00*** | (2006.01) |
| ***C10M 135/18*** | (2006.01) |
| ***C10M 137/10*** | (2006.01) |
| ***C10M 141/12*** | (2006.01) |
| ***C10M 145/14*** | (2006.01) |
| ***C10M 161/00*** | (2006.01) |
| ***C10M 163/00*** | (2006.01) |
| ***C10M 167/00*** | (2006.01) |
| *C10N 10/04* | (2006.01) |
| *C10N 10/12* | (2006.01) |
| *C10N 20/02* | (2006.01) |
| *C10N 20/04* | (2006.01) |
| *C10N 20/00* | (2006.01) |
| *C10N 30/02* | (2006.01) |
| *C10N 30/04* | (2006.01) |
| *C10N 30/06* | (2006.01) |
| *C10N 30/00* | (2006.01) |
| *C10N 40/25* | (2006.01) |
| *C10N 60/14* | (2006.01) |

(52) U.S. Cl.

CPC ..... *C10M 169/044* (2013.01); *C10M 129/54* (2013.01); *C10M 135/18* (2013.01); *C10M 137/10* (2013.01); *C10M 139/00* (2013.01); *C10M 141/12* (2013.01); *C10M 145/14* (2013.01); *C10M 161/00* (2013.01); *C10M 163/00* (2013.01); *C10M 167/00* (2013.01); *C10M 2203/003* (2013.01); *C10M 2207/144* (2013.01); *C10M 2207/262* (2013.01); *C10M 2209/084* (2013.01); *C10M 2219/046* (2013.01); *C10M 2219/068* (2013.01); *C10M 2223/045* (2013.01); *C10M 2227/00* (2013.01); *C10M 2227/066* (2013.01); *C10N 2010/04* (2013.01); *C10N 2010/12* (2013.01); *C10N 2020/019* (2020.05); *C10N 2020/02* (2013.01); *C10N 2020/04* (2013.01); *C10N 2030/02* (2013.01); *C10N 2030/04* (2013.01); *C10N 2030/06* (2013.01); *C10N 2030/42* (2020.05); *C10N 2030/52* (2020.05); *C10N 2030/54* (2020.05); *C10N 2030/68* (2020.05); *C10N 2030/78* (2020.05); *C10N 2040/255* (2020.05); *C10N 2060/14* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,219,666 | A | 11/1965 | Norman et al. | |
| 3,272,746 | A | 9/1966 | Le Suer et al. | |
| 3,313,727 | A | 4/1967 | Peeler | |
| 3,819,521 | A | 6/1974 | Sims | |
| 3,853,772 | A | 12/1974 | Adams | |
| 3,907,601 | A | 9/1975 | Schaefer | |
| 3,997,454 | A | 12/1976 | Adams | |
| 4,089,790 | A | 5/1978 | Adams | |
| 4,320,019 | A | 3/1982 | Hayashi | |
| 4,584,115 | A | 4/1986 | Davis | |
| 6,534,450 | B1 | 3/2003 | Harrison et al. | |
| 6,737,387 | B2 | 5/2004 | Harrison et al. | |
| 8,076,275 | B2 | 12/2011 | Ruhe, Jr. et al. | |
| 2002/0038543 | A1* | 4/2002 | Nishimura | F01N 3/0842 60/284 |
| 2007/0123437 | A1 | 5/2007 | Boffa et al. | |
| 2011/0130317 | A1* | 6/2011 | Stevenson | C09D 11/326 508/547 |
| 2012/0108476 | A1* | 5/2012 | Morcos | C10M 145/14 508/206 |
| 2015/0045271 | A1* | 2/2015 | Yoshida | C10M 169/042 508/364 |
| 2015/0111797 | A1* | 4/2015 | Lyon | C10M 171/02 508/192 |
| 2015/0175927 | A1* | 6/2015 | Utaka | C10M 167/00 508/364 |
| 2015/0322369 | A1* | 11/2015 | Patel | C10M 163/00 508/162 |
| 2017/0066991 | A1* | 3/2017 | Ushioda | C10M 133/44 |
| 2017/0121627 | A1* | 5/2017 | Ishikawa | C10M 129/50 |
| 2018/0245015 | A1* | 8/2018 | Moniz | C10M 163/00 |

* cited by examiner

*Primary Examiner* — Prem C Singh
*Assistant Examiner* — Chantel L Graham

(57) ABSTRACT

Provided is an internal combustion engine lubricating oil composition having a major amount of an oil of lubricating viscosity; a combination of alkaline earth metal alkylhydroxybenzoate detergents; at least about 50 to about 500 ppm of boron from a boron containing detergent; a molybdenum containing compound in an amount to provide the lubricating oil composition from about 100 to about 1500 ppm molybdenum; a ZnDTP compound; where the composition comprises magnesium in an amount from about 100 to about 800 ppm, and calcium in an amount from about 500 to about 2000 ppm.

19 Claims, No Drawings

LOW VISCOSITY LUBRICATING OIL COMPOSITION

This patent application claims priority to U.S. Provisional application Ser. 62/574,955 filed on Oct. 20, 2017.

TECHNICAL FIELD

The disclosed technology relates to lubricants for internal combustion engines, particularly those for spark ignition engines.

BACKGROUND OF THE DISCLOSURE

Modern engine designs are being developed to improve fuel economy without sacrificing performance or durability. Hybrid vehicles and boosted, direct injection engines are continuing to be introduced in order to improve fuel consumption of gasoline engines. The introduction of boosted, direct fuel-injected engines makes it possible to increase torque at low rpm and lower displacement while maintaining the same output. Consequently, fuel consumption can be improved and the proportion of mechanical loss can be reduced. On the other hand, in boosted, direct fuel-injected engines, the problem of sudden abnormal combustion in the form of low speed pre-ignition (LSPI) occurs when torque at low rpm is increased. The occurrence of LSPI places limitations on improvement of fuel consumption while also causing an increase in mechanical loss.

Engine oil is blended with various additives in order to satisfy various performance requirements. One well known way to increase fuel economy is to decrease the viscosity of the lubricating oil. However, this approach is now reaching the limits of current equipment capabilities and specifications. At a given viscosity, it is well known that adding organic or organometallic friction modifiers reduces the surface friction of the lubricating oil and allows for better fuel economy. However, these additives often bring with them detrimental effects such as increased deposit formation, seals impacts, or they out-compete the anti-wear components for limited surface sites, thereby not allowing the formation of an anti-wear film, causing increased wear.

A major challenge in engine oil formulation is simultaneously achieving wear, deposit, and varnish control while also achieving improved fuel economy. Despite the advances in lubricant oil formulation technology, there exists a need for a low viscosity engine oil lubricant suitable for both hybrid vehicles and direct injection engines that effectively improves fuel economy while maintaining or improving wear, friction reduction properties, and deposit control.

This disclosure on lubricating oil composition addresses the issue of fuel economy while at the same time addressing LSPI performance, wear, and deposit control at low viscosity.

SUMMARY OF THE DISCLOSURE

An internal combustion engine lubricating oil composition comprises a major amount of an oil of lubricating viscosity and an overbased alkylhydroxybenzoate detergent having an alkyl group having an average carbon atom number in the range of 14 to 18. The internal combustion engine lubricating oil composition can further include an overbased alkylhydroxybenzoate detergent having an alkyl group having an average carbon atom number in the range of 20 to 28. Moreover, the internal combustion engine lubricating oil composition can include at least about 50 to about 500 ppm of boron from a boron containing detergent which can be from any of the aforementioned alkylhydroxybenzoate detergents, an additional detergent, or a combination thereof. The internal combustion engine lubricating oil composition can further include a molybdenum containing compound in an amount to provide the lubricating oil composition from about 100 to about 1500 ppm molybdenum. Moreover, the internal combustion engine lubricating oil composition can further include a molybdenum containing compound in an amount to provide the lubricating oil composition from about 100 to about 1500 ppm molybdenum. The internal combustion engine lubricating oil composition can further include a ZnDTP compound. In one embodiment, the internal combustion engine lubricating oil composition can further comprise magnesium in an amount from about 100 to about 800 ppm, and calcium in an amount from about 500 to about 2000 ppm. In one further embodiment, internal combustion engine lubricating oil composition can further include that the mole ratio of the overbased alkylhydroxybenzoate detergent having an alkyl group having an average carbon atom number in the range of 14 to 18 and the overbased alkylhydroxybenzoate detergent having an alkyl group having an average carbon atom number in the range of 20 to 28 is from 1:5 to 5:1 based on the alkylhydroxybenzoate molecules.

DETAILED DESCRIPTION OF THE DISCLOSURE

To facilitate the understanding of the subject matter disclosed herein, a number of terms, abbreviations or other shorthand as used herein are defined below. Any term, abbreviation or shorthand not defined is understood to have the ordinary meaning used by a skilled artisan contemporaneous with the submission of this application.

Definitions

In this specification, the following words and expressions, if and when used, have the meanings given below.

A "major amount" means in excess of 50 weight % of a composition.

A "minor amount" means less than 50 weight % of a composition, expressed in respect of the stated additive and in respect of the total mass of all the additives present in the composition, reckoned as active ingredient of the additive or additives.

"Active ingredients" or "actives" refers to additive material that is not diluent or solvent.

All percentages reported are weight % on an active ingredient basis (i.e., without regard to carrier or diluent oil) unless otherwise stated.

The abbreviation "ppm" means parts per million by weight, based on the total weight of the lubricating oil composition.

High temperature high shear (HTHS) viscosity at 150° C. was determined in accordance with ASTM D4683.

Kinematic viscosity at 100° C. ($KV_{100}$) was determined in accordance with ASTM D445.

Metal—The term "metal" refers to alkali metals, alkaline earth metals, or mixtures thereof.

Throughout the specification and claims the expression oil soluble or dispersible is used. By oil soluble or dispersible is meant that an amount needed to provide the desired level of activity or performance can be incorporated by being dissolved, dispersed or suspended in an oil of lubricating viscosity. Usually, this means that at least about 0.001% by weight of the material can be incorporated in a lubricating oil composition. For a further discussion of the terms oil soluble and dispersible, particularly "stably dispersible", see U.S. Pat. No. 4,320,019 which is expressly incorporated herein by reference for relevant teachings in this regard.

The term "sulfated ash" as used herein refers to the non-combustible residue resulting from detergents and metallic additives in lubricating oil. Sulfated ash may be determined using ASTM Test D874.

The term "Total Base Number" or "TBN" as used herein refers to the amount of base equivalent to milligrams of KOH in one gram of sample. Thus, higher TBN numbers reflect more alkaline products, and therefore a greater alkalinity. TBN was determined using ASTM D 2896 test.

Unless otherwise specified, all percentages are in weight percent.

In general, the level of sulfur in the lubricating oil compositions of the present disclosure is less than or equal to about 0.7 wt. %, based on the total weight of the lubricating oil composition, e.g., a level of sulfur of about 0.01 wt. % to about 0.70 wt. %, 0.01 to 0.6 wt. %, 0.01 to 0.5 wt. %, 0.01 to 0.4 wt. %, 0.01 to 0.3 wt. %, 0.01 to 0.2 wt. %, 0.01 wt. % to 0.10 wt. %. In one embodiment, the level of sulfur in the lubricating oil compositions of the present disclosure is less than or equal to about 0.60 wt. %, less than or equal to about 0.50 wt. %, less than or equal to about 0.40 wt. %, less than or equal to about 0.30 wt. %, less than or equal to about 0.20 wt. %, less than or equal to about 0.10 wt. % based on the total weight of the lubricating oil composition.

In one embodiment, the levels of phosphorus in the lubricating oil compositions of the present disclosure is less than or equal to about 0.12 wt. %, based on the total weight of the lubricating oil composition, e.g., a level of phosphorus of about 0.01 wt. % to about 0.12 wt. %. In one embodiment, the levels of phosphorus in the lubricating oil compositions of the present disclosure is less than or equal to about 0.11 wt. %, based on the total weight of the lubricating oil composition, e.g., a level of phosphorus of about 0.01 wt. % to about 0.11 wt. %. In one embodiment, the levels of phosphorus in the lubricating oil compositions of the present disclosure is less than or equal to about 0.10 wt. %, based on the total weight of the lubricating oil composition, e.g., a level of phosphorus of about 0.01 wt. % to about 0.10 wt. %. In one embodiment, the levels of phosphorus in the lubricating oil compositions of the present disclosure is less than or equal to about 0.09 wt. %, based on the total weight of the lubricating oil composition, e.g., a level of phosphorus of about 0.01 wt. % to about 0.09 wt. %. In one embodiment, the levels of phosphorus in the lubricating oil compositions of the present disclosure is less than or equal to about 0.08 wt. %, based on the total weight of the lubricating oil composition, e.g., a level of phosphorus of about 0.01 wt. % to about 0.08 wt. %. In one embodiment, the levels of phosphorus in the lubricating oil compositions of the present disclosure is less than or equal to about 0.07 wt. %, based on the total weight of the lubricating oil composition, e.g., a level of phosphorus of about 0.01 wt. % to about 0.07 wt. %. In one embodiment, the levels of phosphorus in the lubricating oil compositions of the present disclosure is less than or equal to about 0.05 wt. %, based on the total weight of the lubricating oil composition, e.g., a level of phosphorus of about 0.01 wt. % to about 0.05 wt. %. In one embodiment, the lubricating oil is substantially free of phosphorus.

In one embodiment, the level of sulfated ash produced by the lubricating oil compositions of the present disclosure is less than or equal to about 1.60 wt. % as determined by ASTM D 874, e.g., a level of sulfated ash of from about 0.10 to about 1.60 wt. % as determined by ASTM D 874. In one embodiment, the level of sulfated ash produced by the lubricating oil compositions of the present disclosure is less than or equal to about 1.00 wt. % as determined by ASTM D 874, e.g., a level of sulfated ash of from about 0.10 to about 1.00 wt. % as determined by ASTM D 874. In one embodiment, the level of sulfated ash produced by the lubricating oil compositions of the present disclosure is less than or equal to about 0.80 wt. % as determined by ASTM D 874, e.g., a level of sulfated ash of from about 0.10 to about 0.80 wt. % as determined by ASTM D 874. In one embodiment, the level of sulfated ash produced by the lubricating oil compositions of the present disclosure is less than or equal to about 0.60 wt. % as determined by ASTM D 874, e.g., a level of sulfated ash of from about 0.10 to about 0.60 wt. % as determined by ASTM D 874.

All ASTM standards referred to herein are the most current versions as of the filing date of the present application.

While the disclosure is susceptible to various modifications and alternative forms, specific embodiments thereof are herein described in detail. It should be understood, however, that the description herein of specific embodiments is not intended to limit the disclosure to the particular forms disclosed, but on the contrary, the intention is to cover all modifications, equivalents, and alternatives falling within the spirit and scope of the disclosure as defined by the appended claims.

Note that not all of the activities described in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described herein with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or other features that are inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the embodiments of the disclosure. This description should be read to include one or at least one and the singular also includes the plural, or vice versa, unless it is clear that it is meant otherwise. The term "averaged," when referring to a value, is intended to mean an average, a geometric mean, or a median value. Group numbers corresponding to columns within the Periodic Table of the elements use the "New Notation" convention as seen in the CRC Handbook of Chemistry and Physics, 81st Edition (2000-2001).

Unless otherwise defined, all technical and scientific terms used herein have the same meaning as commonly understood by one of ordinary skill in the art to which this disclosure belongs. The materials, methods, and examples are illustrative only and not intended to be limiting. To the extent not described herein, many details regarding specific materials and processing acts are conventional and may be found in textbooks and other sources within the lubricants as well as the oil and gas industries.

The specification and illustrations are not intended to serve as an exhaustive and comprehensive description of all the elements and features of formulations, compositions, apparatus and systems that use the structures or methods described herein. Separate embodiments may also be provided in combination in a single embodiment, and conversely, various features that are, for brevity, described in the context of a single embodiment, may also be provided separately or in any sub-combination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

In one aspect, an internal combustion engine lubricating oil composition comprising:

a. a major amount of an oil of lubricating viscosity;
b. an alkaline earth metal alkylhydroxybenzoate detergent having an alkyl group having an average carbon atom number in the range of 14 to 18;
c. an alkaline earth metal alkylhydroxybenzoate detergent having an alkyl group having an average carbon atom number in the range of 20 to 28;
d. at least about 50 to about 500 ppm of boron from a boron containing detergent which can be from b), c), another detergent, or a combination thereof;
e. a molybdenum containing compound in an amount to provide the lubricating oil composition from about 100 to about 1500 ppm molybdenum;
f. a ZnDTP compound; and where the composition comprises magnesium in an amount from about 100 to about 800 ppm, and calcium in an amount from about 500 to about 2000 ppm and where the mole ratio of b:c is from about 1:5 to about 5:1 based on the alkylhydroxybenzoate molecules and the lubricating oil composition has a phosphorus content of less than or equal to about 0.12 wt. %.

Oil of Lubricating Viscosity

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural and synthetic lubricating oils and combinations thereof.

Natural oils include animal and vegetable oils, liquid petroleum oils and hydrorefined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes); alkylbenzenes (e.g., dodecylbenzenes, tetradecylbenzenes, dinonylbenzenes, di(2-ethylhexyl)benzenes, Alkylated Naphthalene; polyphenols (e.g., biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g., malonic acid, alkyl malonic acids, alkenyl malonic acids, succinic acid, alkyl succinic acids and alkenyl succinic acids, maleic acid, fumaric acid, azelaic acid, suberic acid, sebacic acid, adipic acid, linoleic acid dimer, phthalic acid) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

The base oil may be derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized; hydrocracked and hydroisomerized; dewaxed; or hydroisomerized and dewaxed; using processes known to those skilled in the art.

Unrefined, refined and re-refined oils can be used in the present lubricating oil composition. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art.

Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Hence, the base oil which may be used to make the present lubricating oil composition may be selected from any of the base oils in Groups I-V as specified in the American Petroleum Institute (API) Base Oil Interchangeability Guidelines (API Publication 1509). Such base oil groups are summarized in Table 1 below:

TABLE 1

| Group[a] | Base Oil Properties | | |
|---|---|---|---|
| | Saturates[b], wt. % | Sulfur[c], wt. % | Viscosity Index[d] |
| Group I | <90 and/or | >0.03 | 80 to <120 |
| Group II | ≥90 | ≤0.03 | 80 to <120 |
| Group III | ≥90 | ≤0.03 | ≥120 |
| Group IV | Polyalphaolefins (PAOs) | | |
| Group V | All other base stocks not included in Groups I, II, III or IV | | |

[a]Groups I-III are mineral oil base stocks.
[b]Determined in accordance with ASTM D2007.
[c]Determined in accordance with ASTM D2622, ASTM D3120, ASTM D4294 or ASTM D4927.
[d]Determined in accordance with ASTM D2270.

Base oils suitable for use herein are any of the variety corresponding to API Group II, Group III, Group IV, and Group V oils and combinations thereof, preferably the Group III to Group V oils due to their exceptional volatility, stability, viscometric and cleanliness features.

The oil of lubricating viscosity for use in the lubricating oil compositions of this disclosure, also referred to as a base oil, is typically present in a major amount, e.g., an amount of greater than 50 wt. %, preferably greater than about 70 wt. %, more preferably from about 80 to about 99.5 wt. % and most preferably from about 85 to about 98 wt. %, based on the total weight of the composition. The expression "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both. The base oil for use herein can be any presently known or later-discovered oil of lubricating viscosity used in formulating lubricating oil compositions for any and all such applications, e.g., engine oils, marine cylinder oils, functional fluids such as hydraulic oils, gear oils, transmission fluids, etc. Additionally, the base oils for use herein can optionally contain viscosity index improvers, e.g., polymeric alkylmethacrylates; olefinic copolymers, e.g., an ethylene-propylene copolymer or a styrene-butadiene copolymer; and the like and mixtures thereof. The topology of viscosity modifier could include, but is not limited to, linear, branched, hyperbranched, star, or comb topology.

As one skilled in the art would readily appreciate, the viscosity of the base oil is dependent upon the application. Accordingly, the viscosity of a base oil for use herein will ordinarily range from about 2 to about 2000 centistokes (cSt) at 100° Centigrade (C.). Generally, individually the base oils used as engine oils will have a kinematic viscosity range at 100° C. of about 2 cSt to about 30 cSt, preferably about 3 cSt to about 16 cSt, and most preferably about 4 cSt to about 12 cSt and will be selected or blended depending on the desired end use and the additives in the finished oil to give the desired grade of engine oil, e.g., a lubricating oil composition having an SAE Viscosity Grade of 0W, 0W-8, 0W-12, 0W-16, 0W-20, 0W-26, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, 15W-40, 30, 40 and the like.

The lubricating oil composition has a viscosity index of at least 135 (e.g., 135 to 400, or 135 to 250), at least 150 (e.g., 150 to 400, 150 to 250), at least 165 (e.g., 165 to 400, or 165 to 250), at least 190 (e.g., 190 to 400, or 190 to 250), or at least 200 (e.g., 200 to 400, or 200 to 250). If the viscosity index of the lubricating oil composition is less than 135, it may be difficult to improve fuel efficiency while maintaining the HTHS viscosity at 150° C. If the viscosity index of the lubricating oil composition exceeds 400, evaporation properties may be reduced, and deficits due to insufficient solubility of the additive and matching properties with a seal material may be caused.

The lubricating oil composition has a high temperature shear (HTHS) viscosity at 150° C. of 3.5 cP or less (e.g., 1.0 to 3.5 cP), 3.3 cP or less (e.g., 1.0 to 3.3 cP), 3.0 cP or less (e.g., 1.3 to 3.0 cP), 2.6 cP or less (e.g., 1.3 to 2.6 cP), 2.3 cP or less (e.g., 1.0 to 2.3 cP, or 1.3 to 2.3 cP), such as 2.0 cP or less (e.g., 1.0 to 2.0 cP, or 1.3 to 2.0 cP), or even 1.7 cP or less (e.g., 1.0 to 1.7 cP, or 1.3 to 1.7 cP).

The lubricating oil composition has a kinematic viscosity at 100° C. in a range of 3 to 12 $mm^2/s$ (e.g., 3 to 6.9 $mm^2/s$, 3.5 to 6.9 $mm^2/s$, or 4 to 6.9 $mm^2/s$).

Suitably, the present lubricating oil composition may have a total base number (TBN) of 4 to 15 mg KOH/g (e.g., 5 to 12 mg KOH/g, 6 to 12 mg KOH/g, or 8 to 12 mg KOH/g).

Alkaline Earth Metal Alkylhydroxybenzoate Detergent

In one embodiment, one alkylhydroxybenzoate detergent includes an alkyl group comprising from about 14 to about 18 carbon atoms and a second alkylhydroxybenzoate detergent includes an alkyl group comprising from about 20 to about 28 carbon atoms. The mole ratio between the two detergents can be from about 1:5 to about 5:1, such as from about 1:4 to about 4:1, from about 1:3 to about 3:1, from about 1:2 to about 2:1, from about 2:3 to about 3:2, or from about 3:4 to about 4:3 based on the alkylhydroxybenzoate moieties. In one particular embodiment, the mole ratio is 1:1 with a deviation of 10%, (i.e., between 0.9:1 and 1:1.1).

In one embodiment, the alkylhydroxybenzoate detergent is a salicylate detergent. The salicylate detergent can be an alkaline earth metal salt, such as magnesium, calcium, or the combination thereof. In one embodiment, the above-mentioned component can be a calcium or magnesium salicylate having an alkyl group having an average carbon atom number in the range of from about 14 to about 18, at least 60 mol. % of said alkyl group having a carbon atom number in the range of from about 14 to about 18 preferably is a mixture comprising plural calcium or magnesium salicylates having an alkyl group having an average carbon atom number in the range of from about 14 to about 18 in an amount of 60 mol. % or more, particularly 70 mol. % or more.

In one further embodiment, the second alkylhydroxybenzoate detergent is a salicylate detergent. The salicylate detergent can be an alkaline earth metal salt, such as magnesium, calcium, or the combination thereof. In one embodiment, the second alkylhydroxybenzoate detergent can be calcium or magnesium salicylate having an alkyl group having an average carbon atom number in the range of from about 20 to about 28, at least 60 mol. % of said alkyl group having a carbon atom number in the range of from about 20 to about 28 preferably is a mixture comprising plural calcium or magnesium salicylates having an alkyl group having an average carbon atom number in the range of from about 20 to about 28 in an amount of 60 mol. % or more, particularly 70 mol. % or more.

The alkylhydroxybenzoate detergents can be neutral or overbased.

Overbased metal detergents are generally produced by carbonating a mixture of hydrocarbons, detergent acid, for example: sulfonic acid, alkylhydroxybenzoate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased, e.g., an overbased salt having a TBN below 100 on an actives basis. In one embodiment, the TBN of a low overbased salt may be from about 30 to about 100. In another embodiment, the TBN of a low overbased salt may be from about 30 to about 80. Overbased detergents may be medium overbased, e.g., an overbased salt having a TBN from about 100 to about 250. In one embodiment, the TBN of a medium overbased salt may be from about 100 to about 200. In another embodiment, the TBN of a medium overbased salt may be from about 125 to about 175. Overbased detergents may be high overbased, e.g., an overbased salt having a TBN above 250. In one embodiment, the TBN of a high overbased salt may be from about 250 to about 800 on an actives basis.

The alkylhydroxybenzoate detergents can be derived from a number of hydroxyaromatic compounds. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

In an aspect, the calcium detergent(s) can be added in an amount sufficient to provide the lubricating oil composition from about 500 to about 2000 ppm of calcium metal, from 500 to about 1800 ppm of calcium metal, from 500 to about 1600 ppm of calcium metal, from 500 to about 1500 ppm of calcium metal, or from about 500 to about 1400 ppm, or from about 600 to about 1400 ppm, or from about 600 to about 1400 ppm, or from about 800 to about 1400 ppm, of calcium metal in the lubricating oil composition.

In one embodiment, the magnesium detergent(s) can be added in an amount sufficient to provide the lubricating oil composition from about 100 to about 800 ppm of magnesium metal, or from about 100 to about 700 ppm, or from about 100 to about 600 ppm, or from about 200 to about 500 ppm of magnesium metal in the lubricating oil composition. The lubricating oil composition of the disclosure can further contain additional metal-containing detergents than the above-mentioned components. These detergents include oil-soluble sulfonate, non-sulfur containing phenate, sulfurized phenates, salixarate, salicylate, saligenin, complex detergents and naphthenate detergents and other oil-soluble alkylhydroxybenzoates of a metal, particularly the alkali or alkaline earth metals, e.g., barium, sodium, potassium, lithium, calcium, and magnesium. These can be neutral or overbased. The most commonly used metals are calcium and magnesium, which may both be present in detergents used in a lubricant, and mixtures of calcium and/or magnesium with sodium.

Boron Containing Detergent

The composition further comprises a boron containing detergent. These detergents include oil-soluble sulfonate, non-sulfur containing phenate, sulfurized phenates, salixarate, salicylate, saligenin, complex detergents and naphthenate detergents and other oil-soluble alkylhydroxybenzoates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Particularly preferred borated detergents include sulfonate and salicylate.

Examples of borated sulfonates include borated alkaline earth metal sulfonates obtained by (a) reacting in the presence of a hydrocarbon solvent (i) at least one of an oil-soluble sulfonic acid or alkaline earth sulfonate salt or mixtures thereof; (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction. Suitable borated alkaline earth metal sulfonates include those disclosed in, for example, U.S. Patent Application Publication No. 20070123437, the contents of which are incorporated by reference herein.

Examples of borated salicylates include borated alkaline earth metal salicylates obtained by (a) reacting in the presence of a hydrocarbon solvent (i) at least one of an oil-soluble salicylic acid or alkaline earth salicylate salt or mixtures thereof; (ii) at least one source of an alkaline earth metal; (iii) at least one source of boron, and (iv) from 0 to less than 10 mole percent, relative to the source of boron, of an overbasing acid, other than the source of boron; and (b) heating the reaction product of (a) to a temperature above the distillation temperature of the hydrocarbon solvent to distill the hydrocarbon solvent and water from the reaction.

The borated detergent provides the lubricating oil compositions of the present disclosure with from about 50 to about 500 ppm, from about 60 to about 500 ppm, from about 70 to about 500 ppm, from about 80 to about 500 ppm, from about 90 to about 500 ppm, from about 100 to about 500 ppm, from about 110 to about 500 ppm of boron, from about 120 to about 500 ppm, from about 130 to about 500 ppm, from about 140 to about 500 ppm, from about 150 to about 500 ppm, from about 160 to about 500 ppm, from about 170 to about 500 ppm, from about 180 to about 500 ppm, from about 190 to about 500 ppm, or from about 200 to about 500 ppm of boron based upon the total mass of the composition, provided from the boron containing detergents. The boron containing detergent can be the alkylhydroxybenzoate detergents described herein, from another detergent, or a combination thereof.

Additional Oil Soluble Boron Components

The composition can further include additional boron containing compounds. Examples are given below.

Further examples of at least one oil-soluble or dispersed oil-stable boron-containing compound for use in the lubricating oil compositions of the present disclosure include a borated dispersant; a borated friction modifier; a dispersed alkali metal or a mixed alkali metal or an alkaline earth metal borate, a borated epoxide, a borate ester, a borated fatty amine, a borated amide, and the like, and mixtures thereof.

Examples of borated dispersants include, but are not limited to, borated ashless dispersants such as the borated polyalkenyl succinic anhydrides; borated non-nitrogen containing derivatives of a polyalkylene succinic anhydride; a borated basic nitrogen compound selected from the group consisting of succinimides, carboxylic acid amides, hydrocarbyl monoamines, hydrocarbyl polyamines, Mannich bases, phosphonoamides, thiophosphonamides and phosphoramides, thiazoles, e.g., 2,5-dimercapto-1,3,4-thiadiazoles, mercaptobenzothiazoles and derivatives thereof, triazoles, e.g., alkyltriazoles and benzotriazoles, copolymers which contain a carboxylate ester with one or more additional polar function, including amine, amide, imine, imide, hydroxyl, carboxyl, and the like, e.g., products prepared by copolymerization of long chain alkyl acrylates or methacrylates with monomers of the above function; and the like and mixtures thereof. A preferred borated dispersant is a succinimide derivative of boron such as, for example, a borated polyisobutenyl succinimide.

Examples of borated friction modifiers include, but are not limited to, borated fatty epoxides, borated alkoxylated fatty amines, borated glycerol esters and the like and mixtures thereof.

The hydrated particulate alkali metal borates are well known in the art and are available commercially. Representative examples of hydrated particulate alkali metal borates and methods of manufacture include those disclosed in, e.g., U.S. Pat. Nos. 3,313,727; 3,819,521; 3,853,772; 3,907,601; 3,997,454; 4,089,790; 6,737,387 and 6,534,450, the contents of which are incorporated herein by reference. The hydrated alkali metal borates can be represented by the following Formula: $M_2O.mB_2O_3.nH_2O$ where M is an alkali metal of atomic number in the range of about 11 to about 19, e.g., sodium and potassium; m is a number from about 2.5 to about 4.5 (both whole and fractional); and n is a number from about 1.0 to about 4.8. Preferred are the hydrated sodium borates. The hydrated borate particles generally have a mean particle size of less than about 1 micron.

Examples of borated epoxides include borated epoxides obtained from the reaction product of one or more of the boron compounds with at least one epoxide. Suitable boron compounds include boron oxide, boron oxide hydrate, boron trioxide, boron trifluoride, boron tribromide, boron trichloride, boron acids such as boronic acid, boric acid, tetraboric acid and metaboric acid, boron amides and various esters of boron acids. The epoxide is generally an aliphatic epoxide having from about 8 to about 30 carbon atoms and preferably from about 10 to about 24 carbon atoms and more preferably from about 12 to about 20 carbon atoms. Suitable aliphatic epoxides include dodecene oxide, hexadecene oxide and the like and mixtures thereof. Mixtures of epoxides may also be used, for instance commercial mixtures of epoxides having from about 14 to about 16 carbon atoms or from about 14 to about 18 carbon atoms. The borated epoxides are generally known and described in, for example, U.S. Pat. No. 4,584,115.

Examples of borate esters include those borate esters obtained by reacting one or more of the boron compounds disclosed above with one or more alcohols of suitable oleophilicity. Typically, the alcohols will contain from 6 to about 30 carbons and preferably from 8 to about 24 carbon atoms. The methods of making such borate esters are well known in the art. The borate esters can also be borated phospholipids. Representative examples of borate esters include those having the structures set forth in Formulae I-III:

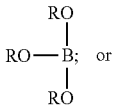

(I)

-continued

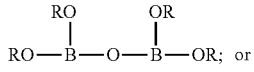

(II)

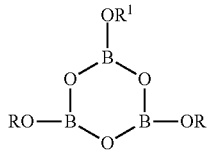

(III)

wherein each R is independently a $C_1$-$C_{12}$ straight or branched alkyl group and $R^1$ is hydrogen or a $C_1$-$C_{12}$ straight or branched alkyl group.

Examples of borated fatty amines include borated fatty amines obtained by reacting one or more of the boron compounds disclosed above with one or more of fatty amines, e.g., an amine having from about fourteen to about eighteen carbon atoms. The borated fatty amines may be prepared by reacting the amine with the boron compound at a temperature in the range of from about 50 to about 300° C., and preferably from about 100 to about 250° C., and at a ratio from about 3:1 to about 1:3 equivalents of amine to equivalents of boron compound.

Examples of borated amides include borated amides obtained from the reaction product of a linear or branched, saturated or unsaturated monovalent aliphatic acid having 8 to about 22 carbon atoms, urea, and polyalkylenepolyamine with a boric acid compound and the like and mixtures thereof.

Organomolybdenum Compound

The internal combustion engine lubricating oil composition comprises a molybdenum-containing compound in an amount of from about 100 to about 1500 ppm molybdenum in terms of molybdenum content in the lubricating oil composition.

The organomolybdenum compound contains at least molybdenum, carbon and hydrogen atoms, but may also contain sulfur, phosphorus, nitrogen and/or oxygen atoms. Suitable organomolybdenum compounds include molybdenum dithiocarbamates, molybdenum dithiophosphates, and various organic molybdenum complexes such as molybdenum carboxylates, molybdenum esters, molybdenum amines, molybdenum amides, which can be obtained by reacting molybdenum oxide or ammonium molybdates with fats, glycerides or fatty acids, or fatty acid derivatives (e.g., esters, amines, amides). The term "fatty" means a carbon chain having 10 to 22 carbon atoms, typically a straight carbon chain.

Molybdenum dithiocarbamate (MoDTC) is an organomolybdenum compound represented by the following structure (1):

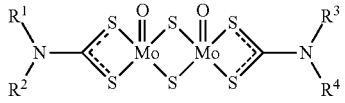

(1)

wherein $R^1$, $R^2$, $R^3$ and $R^4$ are independently of each other, linear or branched alkyl groups having from 4 to 18 carbon atoms (e.g., 8 to 13 carbon atoms).

Molybdenum dithiophosphate (MoDTP) is an organomolybdenum compound represented by the following structure (2):

(2)

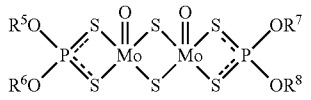

wherein $R^5$, $R^6$, $R^7$ and $R^8$ are independently of each other, linear or branched alkyl groups having from 4 to 18 carbon atoms (e.g., 8 to 13 carbon atoms).

In one embodiment, the molybdenum amine is a molybdenum-succinimide complex. Suitable molybdenum-succinimide complexes are described, for example, in U.S. Pat. No. 8,076,275. These complexes are prepared by a process comprising reacting an acidic molybdenum compound with an alkyl or alkenyl succinimide of a polyamine of structure (3) or (4) or mixtures thereof:

(3)

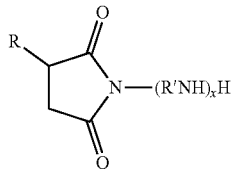

(4)

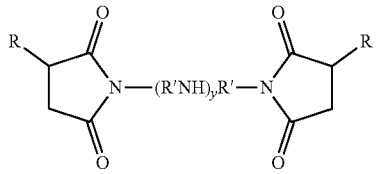

wherein R is a $C_{24}$ to $C_{350}$ (e.g., $C_{70}$ to $C_{128}$) alkyl or alkenyl group; R' is a straight or branched-chain alkylene group having 2 to 3 carbon atoms; x is 1 to 11; and y is 1 to 10.

The molybdenum compounds used to prepare the molybdenum-succinimide complex are acidic molybdenum compounds or salts of acidic molybdenum compounds. By "acidic" is meant that the molybdenum compounds will react with a basic nitrogen compound as measured by ASTM D664 or D2896. Generally, the acidic molybdenum compounds are hexavalent. Representative examples of suitable molybdenum compounds include molybdenum trioxide, molybdic acid, ammonium molybdate, sodium molybdate, potassium molybdate and other alkaline metal molybdates and other molybdenum salts such as hydrogen salts, (e.g., hydrogen sodium molybdate), $MoOCl_4$, $MoO_2Br_2$, $Mo_2O_3Cl_6$, and the like.

The succinimides that can be used to prepare the molybdenum-succinimide complex are disclosed in numerous references and are well known in the art. Certain fundamental types of succinimides and the related materials encompassed by the term of art "succinimide" are taught in U.S. Pat. Nos. 3,172,892; 3,219,666; and 3,272,746. The term "succinimide" is understood in the art to include many of the amide, imide, and amidine species which may also be formed. The predominant product however is a succinimide and this term has been generally accepted as meaning the product of a reaction of an alkyl or alkenyl substituted succinic acid or anhydride with a nitrogen-containing compound. Preferred succinimides are those prepared by reacting a polyisobutenyl succinic anhydride of about 70 to 128 carbon atoms with a polyalkylene polyamine selected from triethylenetetramine, tetraethylenepentamine, and mixtures thereof.

The molybdenum-succinimide complex may be post-treated with a sulfur source at a suitable pressure and a temperature not to exceed 120° C. to provide a sulfurized molybdenum-succinimide complex. The sulfurization step may be carried out for a period of from about 0.5 to 5 hours (e.g., 0.5 to 2 hours). Suitable sources of sulfur include elemental sulfur, hydrogen sulfide, phosphorus pentasulfide, organic polysulfides of formula $R_2S_x$ where R is hydrocarbyl (e.g., $C_1$ to $C_{10}$ alkyl) and x is at least 3, $C_1$ to $C_{10}$ mercaptans, inorganic sulfides and polysulfides, thioacetamide, and thiourea.

The molybdenum compound is used in an amount that provides from about 100 to about 1500 ppm, from about 120 to about 1500 ppm, from about 130 ppm to about 1500 ppm, from about 140 ppm to about 1400 ppm, from about 150 ppm to about 1200 ppm, from about 160 ppm to about 1100 ppm, from about 170 ppm to about 1000 ppm, from about 180 to about 1000 ppm, from about 190 to about 1000 ppm, or from about 200 to about 1000 ppm by weight of molybdenum to the lubricating oil composition.

Zinc Dihydrocarbyl Dithiophosphate (ZnDTP) Compound

Antiwear agents reduce wear of metal parts. Suitable anti-wear agents include dihydrocarbyl dithiophosphate metal salts such as zinc dihydrocarbyl dithiophosphates (ZnDTP) of formula (5):

$$Zn[S—P(=S)(OR^1)(OR^2)]_2 \quad (5)$$

wherein $R^1$ and $R^2$ may be the same of different hydrocarbyl radicals having from 1 to 18 (e.g., 2 to 12) carbon atoms and including radicals such as alkyl, alkenyl, aryl, arylalkyl, alkaryl and cycloaliphatic radicals. Particularly preferred as $R^1$ and $R^2$ groups are alkyl groups having from 2 to 8 carbon atoms (e.g., the alkyl radicals may be ethyl, n-propyl, isopropyl, n-butyl, isobutyl, sec-butyl, n-pentyl, isopentyl, n-hexyl, isohexyl, 2-ethylhexyl). In order to obtain oil solubility, the total number of carbon atoms (i.e., $R^1$+$R^2$) will be at least 5. The zinc dihydrocarbyl dithiophosphate can therefore comprise zinc dialkyl dithiophosphates. The zinc dialkyl dithiophosphate can be a primary or secondary zinc dialkyl dithiophosphate.

ZDDP may be present at 3 wt. % or less (e.g., 0.1 to 1.5 wt. %, or 0.5 to 1.0 wt. %) of the lubricating oil composition.

Viscosity Modifier

The lubricating oil composition can further comprise a viscosity modifier.

Viscosity modifiers function to impart high and low temperature operability to a lubricating oil. The viscosity modifier used may have that sole function, or may be multifunctional. Multifunctional viscosity modifiers that also function as dispersants are also known. Suitable viscosity modifiers include polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene. In one embodiment, the viscosity modifier is a polyalkylmethacrylate. The topology of the viscosity modifier could include, but is not limited to, linear, branched, hyperbranched, star, or comb topology. The viscosity modifier can be non-dispersant type or dispersant type. In one embodiment, the viscosity modifier is a dispersant polymethacrylate.

Suitable viscosity modifiers have a Permanent Shear Stability Index (PSSI) of 30 or less (e.g., 10 or less, 5 or less, or even 2 or less). PSSI is a measure of the irreversible decrease, resulting from shear, in an oil's viscosity contributed by an additive. PSSI is determined according to ASTM D6022. The lubricating oil compositions of the present disclosure display stay-in-grade capability. Retention of kinematic viscosity at 100° C. within a single SAE viscosity grade classification by a fresh oil and its sheared version is evidence of an oil's stay-in-grade capability.

The viscosity modifier may be used in an amount of from 0.5 to 15.0 wt. % (e.g., 0.5 to 10 wt. %, 0.5 to 5 wt. %, 1.0 to 15 wt. %, 1.0 to 10 wt. %, or 1.0 to 5 wt. %), based on the total weight of the lubricating oil composition.

The following is an item list of possible embodiments of the present disclosure:

Item 1. An internal combustion engine lubricating oil composition comprising:
- a. a major amount of an oil of lubricating viscosity;
- b. an alkaline earth metal alkylhydroxybenzoate detergent having an alkyl group having an average carbon atom number in the range of from about 14 to about 18;
- c. an alkaline earth metal alkylhydroxybenzoate detergent having an alkyl group having an average carbon atom number in the range of from about 20 to about 28;
- d. at least about 50 to about 500 ppm of boron from a boron containing detergent which can be from b), c), another detergent, or a combination thereof;
- e. a molybdenum containing compound in an amount to provide the lubricating oil composition from about 100 to about 1500 ppm molybdenum;
- f. a ZnDTP compound; and where the composition comprises magnesium in an amount from about 100 to about 800 ppm, and calcium in an amount from about 500 to about 2000 ppm and where the mole ratio of b:c is from about 1:5 to about 5:1 based on the alkylhydroxybenzoate molecules and the lubricating oil composition has a phosphorus content of less than or equal to about 0.12 wt. %.

Item 2. The lubricating oil composition according to item 1, wherein the boron-containing detergent has from about 50 to about 500 ppm of boron, based on the lubricating oil formulation.

Item 3. The lubricating oil composition of item 1, wherein the boron-containing detergent is a borated salicylate, borated sulfonate, or a combination thereof.

Item 4. The lubricating oil composition of item 1, wherein the lubricating oil composition has a HTHS viscosity at 150° C. in a range of about 1.6 to about 2.9 cP.

Item 5. The lubricating oil composition of item 1, wherein the lubricating oil composition is a 0W-8, 0W-12, 0W-16, or 0W-20 SAE viscosity grade.

Item 6. The lubricating oil composition of item 1, wherein the lubricating oil composition has a kinematic viscosity at 100° C. of from 4.0 to about 9.3 cSt.

Item 7. The lubricating oil composition of item 1, wherein the oil of lubricating viscosity is a base oil selected from one or more of API Group II, Group III, Group IV, and Group V.

Item 8. The lubricating oil composition of item 1, wherein the base oil of lubricating viscosity has a kinematic viscosity at 100° C. of at least 3.0 cSt.

Item 9. The lubricating oil composition of item 1, wherein the organomolybdenum compound is a sulfur-containing organomolybdenum compound or a non-sulfur-containing organomolybdenum compound.

Item 10. The lubricating oil composition of item 1, wherein the organomolybdenum compound is selected from one the group consisting of molybdenum dithiocarbamates, molybdenum dithiophosphates, molybdenum carboxylates, molybdenum esters, molybdenum amines, molybdenum amides, and combinations thereof.

Item 11. The lubricating oil composition of item 1, wherein b) and/or c) is an overbased calcium alkylhydroxybenzoate detergent.

Item 12. The lubricating oil composition of item 1, wherein the ratio of b:c is from 1:3 to 3:1 based on the alkylhydroxybenzoate molecules.

Item 13. The lubricating oil composition of item 1, wherein the magnesium is attained from a magnesium-containing detergent comprises a magnesium sulfonate.

Item 14. The lubricating oil composition of item 1, further comprising a polyalkylmethacrylate viscosity modifier.

Item 15. The lubricating oil composition of item 14, wherein the polyalkylmethacrylate viscosity modifier has an SSI of less than or equal to 30.

Item 16. The lubricating oil composition of item 14, wherein the polyalkylmethacrylate viscosity modifier has an SSI of less than or equal to 5.

Item 17. The lubricating oil composition of item 1, wherein the ZnDTP compound comprises at least a portion of a primary zinc dialkyldithiophosphate.

Item 18. The lubricating oil composition of item 1, wherein the ZnDTP compound comprises at mixture of a primary zinc dialkyldithiophosphate and a secondary zinc dialkyldithiophosphate.

Item 19. The lubricating oil composition of item 1, which is for an internal combustion engine selected from a direct injection spark ignition engine and a port fuel injection spark ignition engine coupled to an electric motor/battery system in a hybrid vehicle.

Item 20. A method for improving fuel economy in an internal combustion engine comprising lubricating said engine with a lubricating oil composition of item 1.

Additional Lubricating Oil Additives

The lubricating oil compositions of the present disclosure may also contain other conventional additives that can impart or improve any desirable property of the lubricating oil composition in which these additives are dispersed or dissolved. Any additive known to a person of ordinary skill in the art may be used in the lubricating oil compositions disclosed herein. Some suitable additives have been described in Mortier et al., "Chemistry and Technology of Lubricants", 2nd Edition, London, Springer, (1996); and Leslie R. Rudnick, "Lubricant Additives: Chemistry and Applications", New York, Marcel Dekker (2003), both of which are incorporated herein by reference. For example, the lubricating oil compositions can be blended with antioxidants, rust inhibitors, dehazing agents, demulsifying agents, metal deactivating agents, friction modifiers, pour point depressants, antifoaming agents, co-solvents, corrosion-inhibitors, ashless dispersants, multifunctional agents, dyes, extreme pressure agents and the like and mixtures thereof. A variety of the additives are known and commercially available. These additives, or their analogous compounds, can be employed for the preparation of the lubricating oil compositions of the disclosure by the usual blending procedures.

In the preparation of lubricating oil formulations, it is common practice to introduce the additives in the form of 10 to 80 wt. % active ingredient concentrates in hydrocarbon oil, e.g. mineral lubricating oil, or other suitable solvent.

Usually these concentrates may be diluted with 3 to 100, e.g., 5 to 40, parts by weight of lubricating oil per part by weight of the additive package in forming finished lubricants, e.g. crankcase motor oils. The purpose of concentrates, of course, is to make the handling of the various materials less difficult and awkward as well as to facilitate solution or dispersion in the final blend.

Each of the foregoing additives, when used, is used at a functionally effective amount to impart the desired properties to the lubricant. Thus, for example, if an additive is a friction modifier, a functionally effective amount of this friction modifier would be an amount sufficient to impart the desired friction modifying characteristics to the lubricant.

In general, the concentration of each of the additives in the lubricating oil composition, when used, may range from about 0.001 wt. % to about 20 wt. %, from about 0.01 wt. % to about 15 wt. %, or from about 0.1 wt. % to about 10 wt. %, from about 0.005 wt. % to about 5 wt. %, or from about 0.1 wt. % to about 2.5 wt. %, based on the total weight of the lubricating oil composition. Further, the total amount of the additives in the lubricating oil composition may range from about 0.001 wt. % to about 20 wt. %, from about 0.01 wt. % to about 10 wt. %, or from about 0.1 wt. % to about 5 wt. %, based on the total weight of the lubricating oil composition.

The following examples are presented to exemplify embodiments of the disclosure but are not intended to limit the disclosure to the specific embodiments set forth. Unless indicated to the contrary, all parts and percentages are by weight. All numerical values are approximate. When numerical ranges are given, it should be understood that embodiments outside the stated ranges may still fall within the scope of the disclosure. Specific details described in each example should not be construed as necessary features of the disclosure.

It will be understood that various modifications may be made to the embodiments disclosed herein. Therefore, the above description should not be construed as limiting, but merely as exemplifications of preferred embodiments. For example, the functions described above and implemented as the best mode for operating the present disclosure are for illustration purposes only. Other arrangements and methods may be implemented by those skilled in the art without departing from the scope and spirit of this disclosure. Moreover, those skilled in the art will envision other modifications within the scope and spirit of the claims appended hereto.

EXAMPLES

The following examples are intended for illustrative purposes only and do not limit in any way the scope of the present disclosure.

Example 1

A lubricating oil composition was prepared that contained a major amount of a base oil of lubricating viscosity and the following additives, to provide a finished oil having a HTHS viscosity at 150° C. of 2.31 cP:

(1) an ethylene carbonate post-treated bis-succinimide;
(2) 0.011 wt. % in terms of boron content, of a 160 TBN borated calcium sulfonate detergent
(3) 0.165 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.040 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 5; and
(11) the remainder, a Group III base oil.

Example 2

A lubricating oil composition was prepared that contained a major amount of a base oil of lubricating viscosity and the following additives, to provide a finished oil having a HTHS viscosity at 150° C. of 2.30 cP:

(1) an ethylene carbonate post-treated bis-succinimide;
(2) 0.011 wt. % in terms of boron content, of a 160 TBN borated calcium sulfonate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a mixture of primary and secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 3

A lubricating oil composition was prepared that contained a major amount of a base oil of lubricating viscosity and the following additives, to provide a finished oil having a HTHS viscosity at 150° C. of 2.31 cP:

(1) an ethylene carbonate post-treated bis-succinimide;
(2) 0.011 wt. % in terms of boron content, of a 160 TBN borated calcium sulfonate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a secondary zinc dialkyldithiophosphate;

(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 4

A lubricating oil composition was prepared that contained a major amount of a base oil of lubricating viscosity and the following additives, to provide a finished oil having a HTHS viscosity at 150° C. of 2.35 cP:
(1) an ethylene carbonate post-treated bis-succinimide;
(2) 0.023 wt. % in terms of boron content, of a 160 TBN borated calcium sulfonate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 5

A lubricating oil composition was prepared that contained a major amount of a base oil of lubricating viscosity and the following additives, to provide a finished oil having a HTHS viscosity at 150° C. of 2.32 cP:
(1) an ethylene carbonate post-treated bis-succinimide;
(2) 0.043 wt. % in terms of boron content, of a 160 TBN borated calcium sulfonate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 6

A lubricating oil composition was prepared that contained a major amount of a base oil of lubricating viscosity and the following additives, to provide a finished oil having a HTHS viscosity at 150° C. of 2.35 cP:
(1) an ethylene carbonate post-treated bis-succinimide;
(2) 0.011 wt. % in terms of boron content, of a 160 TBN borated calcium sulfonate detergent
(3) 0.05 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.08 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 7

A lubricating oil composition was prepared that contained a major amount of a base oil of lubricating viscosity and the following additives, to provide a finished oil having a HTHS viscosity at 150° C. of 2.35 cP:
(1) an ethylene carbonate post-treated bis-succinimide;
(2) 0.011 wt. % in terms of boron content, of a 160 TBN borated calcium sulfonate detergent
(3) 0.20 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.01 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 8

A lubricating oil composition was prepared that contained a major amount of a base oil of lubricating viscosity and the following additives, to provide a finished oil having a HTHS viscosity at 150° C. of 2.32 cP:
(1) an ethylene carbonate post-treated bis-succinimide;
(2) 0.011 wt. % in terms of boron content, of 160 TBN borated calcium sulfonate detergent
(3) 0.20 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);

(4) 0.01 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 9

A lubricating oil composition was prepared that contained a major amount of a base oil of lubricating viscosity and the following additives, to provide a finished oil having a HTHS viscosity at 150° C. of 2.32 cP:
(1) an ethylene carbonate post-treated bis-succinimide;
(2) 0.011 wt. % in terms of boron content, of a 160 TBN borated calcium sulfonate detergent
(3) 0.20 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.01 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 10

A lubricating oil composition was prepared that contained a major amount of a base oil of lubricating viscosity and the following additives, to provide a finished oil having a HTHS viscosity at 150° C. of 2.30 cP:
(1) an ethylene carbonate post-treated bis-succinimide;
(2) 0.011 wt. % in terms of boron content, of a 192 TBN borated calcium salicylate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Example 11

A lubricating oil composition was prepared that contained a major amount of a base oil of lubricating viscosity and the following additives, to provide a finished oil having a HTHS viscosity at 150° C. of 1.87 cP:
(1) an ethylene carbonate post-treated bis-succinimide;
(2) 0.011 wt. % in terms of boron content, of a 160 TBN borated calcium sulfonate detergent
(3) 0.151 wt. % in terms of calcium content, of a mixture of a 168 TBN calcium salicylate detergent, a 323 TBN calcium salicylate detergent, and a 60 TBN calcium salicylate detergent and includes the calcium from the borated detergent from (2);
(4) 0.055 wt. % in terms of magnesium content, of a 400 TBN magnesium sulfonate detergent;
(5) 740 ppm in terms of phosphorus content, of a secondary zinc dialkyldithiophosphate;
(6) 40 ppm in terms of molybdenum, of a molybdenum succinimide antioxidant;
(7) 900 ppm in terms of molybdenum, of a MoDTC complex;
(8) an alkylated diphenylamine;
(9) 5 ppm in terms of silicon content, of a foam inhibitor;
(10) a polyalkylmethacrylate viscosity modifier having a PSSI of 1; and
(11) the remainder, a Group III base oil.

Comparative Example 1

A lubricating oil composition was prepared that contained a major amount of a base oil of lubricating viscosity and the following additives, to provide a finished oil having a HTHS viscosity at 150° C. of 2.31 cP:
(1) an ethylene carbonate post-treated bis-succinimide;
(2) 0.151 wt. % in terms of calcium content, of a mixture a 323 TBN calcium salicylate detergent and a 60 TBN calcium salicylate detergent;
(3) 0.055 wt. % in terms of magnesium content, of a 400 TBN magnesium sulfonate detergent;
(4) 740 ppm in terms of phosphorus content, of a secondary zinc dialkyldithiophosphate;
(5) 40 ppm in terms of molybdenum, of a molybdenum succinimide antioxidant;
(6) 900 ppm in terms of molybdenum, of a MoDTC complex;
(7) an alkylated diphenylamine;
(8) 5 ppm in terms of silicon content, of a foam inhibitor;
(9) a polyalkylmethacrylate viscosity modifier having a PSSI of 1; and
(10) the remainder, a Group III base oil.

Comparative Example 2

A lubricating oil composition was prepared that contained a major amount of a base oil of lubricating viscosity and the following additives, to provide a finished oil having a HTHS viscosity at 150° C. of 2.33 cP:
(1) an ethylene carbonate post-treated bis-succinimide;
(2) 0.011 wt. % in terms of boron content, of a 160 TBN borated calcium sulfonate detergent
(3) 0.151 wt. % in terms of calcium content, of a mixture a 323 TBN calcium salicylate detergent and a 60 TBN calcium salicylate detergent and includes the calcium from the borated detergent from (2);

(4) 0.055 wt. % in terms of magnesium content, of a 400 TBN magnesium sulfonate detergent;

(5) 740 ppm in terms of phosphorus content, of a secondary zinc dialkyldithiophosphate;

(6) 40 ppm in terms of molybdenum, of a molybdenum succinimide antioxidant;

(7) 900 ppm in terms of molybdenum, of a MoDTC complex;

(8) an alkylated diphenylamine;

(9) 5 ppm in terms of silicon content, of a foam inhibitor;

(10) a polyalkylmethacrylate viscosity modifier having a PSSI of 1; and

(11) the remainder, a Group III base oil.

Comparative Example 3

A lubricating oil composition was prepared that contained a major amount of a base oil of lubricating viscosity and the following additives, to provide a finished oil having a HTHS viscosity at 150° C. of 2.35 cP:

(1) an ethylene carbonate post-treated bis-succinimide;

(2) 0.011 wt. % in terms of boron content, of a 160 TBN borated calcium sulfonate detergent (3) 0.20 wt. % in terms of calcium content, of a mixture a 323 TBN calcium salicylate detergent and a 60 TBN calcium salicylate detergent and includes the calcium from the borated detergent from (2);

(4) 740 ppm in terms of phosphorus content, of a secondary zinc dialkyldithiophosphate;

(5) 40 ppm in terms of molybdenum, of a molybdenum succinimide antioxidant;

(6) 900 ppm in terms of molybdenum, of a MoDTC complex;

(7) an alkylated diphenylamine;

(8) 5 ppm in terms of silicon content, of a foam inhibitor;

(9) a polyalkylmethacrylate viscosity modifier having a PSSI of 1; and

(10) the remainder, a Group III base oil.

Comparative Example 4

A lubricating oil composition was prepared that contained a major amount of a base oil of lubricating viscosity and the following additives, to provide a finished oil having a HTHS viscosity at 150° C. of 1.90 cP:

(1) an ethylene carbonate post-treated bis-succinimide;

(2) 0.151 wt. % in terms of calcium content, of a mixture a 323 TBN calcium salicylate detergent and a 60 TBN calcium salicylate detergent and includes the calcium from the borated detergent from (2);

(3) 0.055 wt. % in terms of magnesium content, of a 400 TBN magnesium sulfonate detergent;

(4) 740 ppm in terms of phosphorus content, of a secondary zinc dialkyldithiophosphate;

(5) 40 ppm in terms of molybdenum, of a molybdenum succinimide antioxidant;

(6) 900 ppm in terms of molybdenum, of a MoDTC complex;

(7) an alkylated diphenylamine;

(8) 5 ppm in terms of silicon content, of a foam inhibitor;

(9) a polyalkylmethacrylate viscosity modifier having a PSSI of 1; and

(10) the remainder, a Group III base oil.

The Komatsu Hot Tube Test (KHTT) is used for screening and quality control of deposit formation performance for engine oils and other oils subjected to high temperatures.

Detergency and thermal and oxidative stability are performance areas that are generally accepted in the industry as being essential to satisfactory overall performance of a lubricating oil. The Komatsu Hot Tube test is a lubrication industry bench test (JPI 5S-55-99) that measures the detergency and thermal and oxidative stability of a lubricating oil. During the test, a specified amount of test oil is pumped upwards through a glass tube that is placed inside an oven set at a certain temperature. Air is introduced in the oil stream before the oil enters the glass tube, and flows upward with the oil. Evaluations of the lubricating oils were conducted at a temperature of 280° C. The test result is determined by comparing the amount of lacquer deposited on the glass test tube to a rating scale ranging from 1.0 (very black) to 10.0 (perfectly clean). Results are shown in Tables 2, 3, 4 and 5.

Fuel Economy Testing in a Toyota 2ZR-FE Motored Engine

The lubricating oil compositions of Comparative Examples 1-4 as well as Examples 1-11 were tested for their fuel economy performance in a gasoline motored engine test. Gasoline engines are known to produce very little if any measurable amounts of soot during operation. The engine is a Toyota 2ZR-FE 1.8 L in-line 4-cylinder arrangement. The torque meter is positioned between the motor and the crank shaft of the engine and the % torque change is measured between a reference and candidate oil. % torque change data at oil temperatures of 100° C., 80° C., and 60° C. and engine speeds of 400 to 2000 RPM are measured. Lower % torque change (i.e., more negative) reflects better fuel economy. The configuration of the motored engine friction torque test and its test conditions are further described in SAE Paper 2013-01-2606. The torque data for this test is set forth below in Table 2, 3, 4 and 5.

TABLE 2

| | Ex. 1 | Ex. 2 | Ex. 3 | Ex. 4 | Ex. 5 |
|---|---|---|---|---|---|
| SAE Viscosity Grade | 0W-16 | 0W-16 | 0W-16 | 0W-16 | 0W-16 |
| HTHS Viscosity (150° C.), cP | 2.31 | 2.30 | 2.31 | 2.35 | 2.32 |
| Mg, wt. % | 0.040 | 0.055 | 0.055 | 0.055 | 0.055 |
| Ca, wt. % | 0.165 | 0.151 | 0.151 | 0.151 | 0.151 |
| Mo, wt. % from MoDTC | 0.09 | 0.09 | 0.09 | 0.09 | 0.09 |
| B, wt. % from detergent | 0.011 | 0.011 | 0.011 | 0.026 | 0.043 |
| Salicylate mole Ratio $C_{20-28}$:$C_{14-18}$ | 1.0:1 | 1.1:1 | 1.0:1 | 1.9:1 | 4.6:1 |
| Performance Improvement, compared with Comp. Ex. 1 | | | | | |
| Komatsu Hot Tube Test | | | | | |
| Merit Rating | +0.5 | +0.5 | +1.0 | +1.5 | +2.0 |
| Toyota 2ZR Motored Engine Friction Torque | | | | | |
| 60° C. | −0.6% | −0.8% | −0.5% | −0.2% | −0.1% |
| 80° C. | −0.7% | −0.8% | −0.5% | −0.2% | −0.2% |
| 100° C. | −0.9% | −0.9% | −0.8% | −0.7% | −0.3% |

TABLE 3

| | Comp. Ex. 1 | Comp. Ex. 2 |
|---|---|---|
| SAE Viscosity Grade | 0W-16 | 0W-16 |

TABLE 3-continued

| | Comp. Ex. 1 | Comp. Ex. 2 |
|---|---|---|
| HTHS Viscosity (150° C.), cP | 2.31 | 2.33 |
| Mg, wt. % | 0.055 | 0.055 |
| Ca, wt. % | 0.151 | 0.151 |
| Mo, wt. % from MoDTC | 0.09 | 0.09 |
| B, wt. % from detergent | 0 | 0.011 |
| Salicylate mole Ratio $C_{20-28}$:$C_{14-18}$ | 1:1.3 | 1:0 |
| Performance Improvement, compared with Comp. Ex. 1 | | |
| Komatsu Hot Tube Test | | |
| Merit Rating | (4.0) | +0.5 |
| Toyota 2ZR Torque | | |
| 60° C. | (−2.01%) | +0.2% |
| 80° C. | (−1.62%) | +0.1% |
| 100° C. | (−2.21%) | +0.2% |

TABLE 4

| | Comp Ex. 3 | Ex. 6 | Ex. 7 | Ex. 8 | Ex. 9 | Ex. 10 |
|---|---|---|---|---|---|---|
| SAE Viscosity Grade | 0W-16 | 0W-16 | 0W-16 | 0W-16 | 0W-16 | 0W-16 |
| HTHS Viscosity (150° C.), cP | 2.35 | 2.35 | 2.35 | 2.32 | 2.32 | 2.30 |
| Mg, wt. % | — | 0.08 | 0.01 | 0.01 | 0.01 | 0.055 |
| Ca, wt. % | 0.2 | 0.05 | 0.2 | 0.2 | 0.2 | 0.151 |
| Mo, wt. % from MoDTC | 0.09 | 0.09 | 0.09 | 0.09 | 0.09 | 0.09 |
| B, wt. % from detergent | 0.011 | 0.011 | 0.011 | 0.011 | 0.01 | 0.011 |
| Salicylate mole Ratio $C_{20-28}$:$C_{14-18}$ | 2.6:1 | 2.99:1 | 2.62:1 | 3.66:1 | 1:4.91 | 1.3:1 |
| Performance Improvement, compared with Comp. Ex. 1 | | | | | | |
| Komatsu Hot Tube Test | | | | | | |
| Merit Rating | +1.0 | +0.5 | +1.0 | +1.0 | +1.5 | +0.5 |
| Toyota 2ZR Motored Engine Friction Torque | | | | | | |
| 60° C. | +0.1% | −0.4% | −0.2% | −0.4% | −0.5% | −0.3% |
| 80° C. | 0.0% | −0.8% | −0.5% | −0.6% | −0.5% | −0.6% |
| 100° C. | +0.1% | −0.3% | −0.2% | −0.4% | −0.3% | −0.3% |

TABLE 5

| | Comp. Ex. 4 | Ex. 11 |
|---|---|---|
| SAE Viscosity Grade | 0W-8 | 0W-8 |
| HTHS Viscosity (150° C.), cP | 1.90 | 1.87 |
| Mg, wt. % | 0.055 | 0.055 |
| Ca, wt. % | 0.151 | 0.151 |
| Mo, wt. % from MoDTC | 0.09 | 0.09 |
| B, wt. % from detergent | 0 | 0.011 |
| Salicylate mole Ratio $C_{20-28}$:$C_{14-18}$ | 1.3:1 | 1.3:1 |
| Performance Improvement, compared with Comp. Ex. 1 | | |
| Komatsu Hot Tube Test | | |
| Merit Rating | (4.0) | +0.5 |

TABLE 5-continued

| | Comp. Ex. 4 | Ex. 11 |
|---|---|---|
| Toyota 2ZR Torque | | |
| 60° C. | (−2.01%) | +0.2% |
| 80° C. | (−1.62%) | +0.1% |
| 100° C. | (−2.21%) | +0.2% |

What is claimed is:

1. An internal combustion engine lubricating oil composition comprising:

a. a major amount of an oil of lubricating viscosity;

b. an alkaline earth metal alkylhydroxybenzoate detergent having an alkyl group having an average carbon atom number in the range of from about 14 to about 18;

c. an alkaline earth metal alkylhydroxybenzoate detergent having an alkyl group having an average carbon atom number in the range of from about 20 to about 28;

d. at least about 50 to about 500 ppm of boron from a boron containing detergent which can be from b), c), borated sulfonate, or a combination thereof;

e. a molybdenum containing compound in an amount to provide the lubricating oil composition from about 100 to about 1500 ppm molybdenum; and f. a ZnDTP compound; and where the composition comprises magnesium in an amount from about 100 to about 800 ppm, and calcium in an amount from about 500 to about 2000 ppm and where the mole ratio of b:c is from about 1:5 to about 5:1 based on the alkylhydroxybenzoate molecules and the lubricating oil composition has a phosphorus content of less than or equal to about 0.12 wt. %.

2. The lubricating oil composition according to claim 1, wherein the boron-containing detergent has from about 50 to about 500 ppm of boron, based on the lubricating oil formulation.

3. The lubricating oil composition of claim 1, wherein the lubricating oil composition has a HTHS viscosity at 150° C. in a range of about 1.6 to about 2.9 cP.

4. The lubricating oil composition of claim 1, wherein the lubricating oil composition is a 0W-8, 0W-12, 0W-16, or 0W-20 SAE viscosity grade.

5. The lubricating oil composition of claim 1, wherein the lubricating oil composition has a kinematic viscosity at 100° C. of from 4.0 to about 9.3 cSt.

6. The lubricating oil composition of claim 1, wherein the oil of lubricating viscosity is a base oil selected from one or more of API Group II, Group III, Group IV, and Group V.

7. The lubricating oil composition of claim 1, wherein the base oil of lubricating viscosity has a kinematic viscosity at 100° C. of at least 3.0 cSt.

8. The lubricating oil composition of claim 1, wherein the organomolybdenum compound is a sulfur-containing organomolybdenum compound or a non-sulfur-containing organomolybdenum compound.

9. The lubricating oil composition of claim 1, wherein the organomolybdenum compound is selected from one the group consisting of molybdenum dithiocarbamates, molybdenum dithiophosphates, molybdenum carboxylates, molybdenum esters, molybdenum amines, molybdenum amides, and combinations thereof.

10. The lubricating oil composition of claim 1, wherein b) and/or c) is an overbased calcium alkylhydroxybenzoate detergent.

11. The lubricating oil composition of claim 1, wherein the ratio of b:c is from 1:3 to 3:1 based on the alkylhydroxybenzoate molecules.

12. The lubricating oil composition of claim 1, wherein the magnesium is attained from a magnesium-containing detergent comprises a magnesium sulfonate.

13. The lubricating oil composition of claim 1, further comprising a polyalkylmethacrylate viscosity modifier.

14. The lubricating oil composition of claim 13, wherein the polyalkylmethacrylate viscosity modifier has an SSI of less than or equal to 30.

15. The lubricating oil composition of claim 13, wherein the polyalkylmethacrylate viscosity modifier has an SSI of less than or equal to 5.

16. The lubricating oil composition of claim 1, wherein the ZnDTP compound comprises at least a portion of a primary zinc dialkyldithiophosphate.

17. The lubricating oil composition of claim 1, wherein the ZnDTP compound comprises at mixture of a primary zinc dialkyldithiophosphate and a secondary zinc dialkyldithiophosphate.

18. The lubricating oil composition of claim 1, which is for an internal combustion engine selected from a direct injection spark ignition engine and a port fuel injection spark ignition engine coupled to an electric motor/battery system in a hybrid vehicle.

19. A method for improving fuel economy in an internal combustion engine comprising lubricating said engine with a lubricating oil composition of claim 1.

* * * * *